United States Patent [19]

Buker

[11] 4,039,325

[45] Aug. 2, 1977

[54] VACUUM SMELTING PROCESS FOR PRODUCING FERROMOLYBDENUM

[75] Inventor: Donald O. Buker, Denver, Colo.

[73] Assignee: Amax Inc., New York, N.Y.

[21] Appl. No.: 661,978

[22] Filed: Feb. 27, 1976

Related U.S. Application Data

[63] Continuation-in-part of Ser. No. 508,848, Sept. 24, 1974, Pat. No. 3,966,459.

[51] Int. Cl.[2] ..... C22B 34/00; C22B 9/14

[52] U.S. Cl. ..... 75/84; 75/90 R

[58] Field of Search ..... 75/84, 91, 7, 89, 90 R, 75/92, 11, 12, 44 R, 49, 59, 123 S, 126 C, 176

[56] References Cited

U.S. PATENT DOCUMENTS

| | | | |
|---|---|---|---|
| 2,834,671 | 5/1958 | Nachtman | 75/84 |
| 3,020,151 | 2/1962 | Nachtman | 75/84 |
| 3,152,886 | 10/1964 | Nachtman | 75/84 |
| 3,833,352 | 9/1974 | Vojkovic | 75/84 |
| 3,865,573 | 2/1975 | Neumann | 75/84 |
| 3,966,459 | 6/1976 | Buker | 75/84 |

OTHER PUBLICATIONS

Scholz, et al., Transactions of the Metallurgical Society of Aime, vol. 221, April 1961, pp. 356–364.

*Primary Examiner*—Samuel W. Engle
*Assistant Examiner*—Donald P. Walsh
*Attorney, Agent, or Firm*—Harness, Dickey & Pierce

[57] ABSTRACT

A process for producing ferromolybdenum alloys by agglomerating a finely-particulated mixture containing controlled amounts of molybdenum disulfide and an iron bearing material into a plurality of pellets and heating the pellets to an elevated temperature under a controlled vacuum for a period of time sufficient to effect a dissociation of the molybdenum disulfide and an extraction of the sulfur and other volatile constituents in the pellets and an alloying of the metallic molybdenum produced with the iron bearing material producing substantially dense sintered ferromolybdenum alloy pellets.

20 Claims, No Drawings

VACUUM SMELTING PROCESS FOR PRODUCING FERROMOLYBDENUM

CROSS-REFERENCE TO RELATED APPLICATIONS

This application is a continuation-in-part of my prior copending application Ser. No. 508,848, filed Sept. 24, 1974 for "Process for Thermal Dissociation of Molybdenum Disulfide", now U.S. Pat. No. 3,966,459.

BACKGROUND OF THE INVENTION

The process as described in the aforementioned copending parent application Ser. No. 508,848 is directed to a vacuum dissociation of a pelletized molybdenite concentrated feed material at an elevated temperature enabling recovery of the volatilized sulfur as a valuable by-product and employing a terminal hydrogen sweep treatment to remove the residual sulfur, thereby producing pellets of relatively pure metallic molybdenum. The present continuation-in-part application is directed to the further embodiment of producing ferromolybdenum alloys containing controlled amounts of iron and molybdenum which are eminently suitable for use as an alloying addition agent in steelmaking operations and the like.

Ferromolybdenum alloys are produced in accordance with prior art practices by either employing a thermit process or an electric furnace reduction process. Both of these techniques require substantial amounts of labor and energy and are, therefore, somewhat costly. In the thermit process, for example, a molybdenum oxide feed material derived from the roasting of a molybdenite ($MoS_2$) concentrate is mixed with reducing agents, such as silicon and aluminum, which through an exothermic thermit-type reaction produces an ingot or button of the alloy which is usually of a segregated structure and further requires crushing and sizing prior to shipment and use. The slag produced, for economic reasons, is usually subjected to further treatment for recovery of residual metal values and the treated residue is discarded. In addition to the relatively high costs of the reducing agents required in the thermit process, further problems are presented from an environmental standpoint as a result of the disposal of the slag produced and the treatment required of the gases evolved during the exothermic reaction.

The present process overcomes many of the problems and disadvantages associated with prior art techniques for producing ferromolybdenum alloys by utilizing a molybdenite concentrate directly as the starting material without requiring a roasting treatment to convert the feed to the oxide state. Carbon is employed as a low cost reducing agent, eliminating the formation of any slag, whereby a ferromolybdenum alloy is obtained which is of a nonsegregated structure and sulfur and other constituents evolved during the vacuum smelting operation can be recovered as valuable by-products.

SUMMARY OF THE INVENTION

The benefits and advantages of the process comprising the present invention are achieved by forming a substantially uniform mixture composed of controlled amounts of a finely-particulated molybdenite concentrate consisting predominantly of molybdenum disulfide and a finely-particulated iron bearing material including metallic iron and iron oxide. When iron oxide is employed as all or a portion of the iron bearing material, an appropriate quantity of particulated carbon is added to the mixture as a reducing agent for the iron oxide. The resultant mixture is agglomerated into a plurality of shape-retaining pellets which thereafter are heated to an elevated temperature ranging from about 1800° F to about 3100° F for a period of time sufficient to effect a dissociation of substantially all of the molybdenum disulfide while subjected to a pressure of less than about 10 Torr so as to form metallic molybdenum. The sulfur and other volatile gaseous constituents are continuously withdrawn and the heating is continued to effect a further reduction of any iron oxide constituent present which thereafter is alloyed with the metallic molybdenum constituent producing a ferromolybdenum alloy in the form of relatively dense sintered pellets. The pellets are cooled to a temperature such as about 570° F or below and thereafter are extracted from the vacuum smelting furnace.

Additional advantages and benefits of the present invention will become apparent upon a reading of the description of the preferred embodiments taken in conjunction with the specific examples provided.

DESCRIPTION OF THE PREFERRED EMBODIMENTS

The composition and concentration of the various feed materials, products, by-products and intermediate by-products are described in the specification and subjoined claims in terms of percentages by weight unless clearly indicated to the contrary.

Sintered, dense pellets or briquettes of a ferromolybdenum alloy of the desired composition are produced in accordance with the present process by forming a substantially uniform mixture of a finely-particulated iron bearing material and a commercial molybdenite concentrate which is agglomerated and thereafter heated at an elevated temperature in an environment devoid of oxygen and in a substantial vacuum in a manner to effect a direct thermal dissociation of the molybdenite constituent to form metallic molybdenum and an alloying thereof with the iron to produce the ferromolybdenum alloy. The thermal dissociation reaction of molybdenite is believed to occur in two discrete steps:

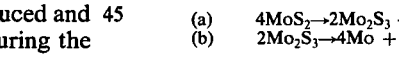

(a) $4MoS_2 \rightarrow 2Mo_2S_3 + S_2\,(gas)$
(b) $2Mo_2S_3 \rightarrow 4Mo + 3S_2\,(gas)$ The gaseous or vaporized sulfur and other volatile constituents present in the molybdenite concentrate which are evolved during the thermal dissociation reaction can readily be recovered in a condenser and comprise valuable by-products of the process. In addition to sulfur, other constituents which are also volatized and removed from the briquettes to effect purification of the ferromolybdenum alloy residue include: silica, iron compounds, aluminum compounds, calcium compounds, lead compounds and oxygen-containing compounds, as well as other conventional impurities normally found in ore deposits containing molybdenite. The substantial reduction in the content of such contaminating constituents renders the resultant ferromolybdenum alloy briquettes eminently suitable in many instances without any further purification for direct use as metallurgical alloying agents in steelmaking operations and the like.

The iron being constituent of the particulated mixture may comprise a finely-divided iron powder or an iron oxide powder in further combination with a carbonaceous reducing agent for effecting a reduction of the iron oxide to the metallic state during the vacuum smelting operation. When a metallic iron powder is employed as the iron bearing constituent, the powder is of a particle size ranging from about 175 microns up to about 74 microns, and preferably of an average particle size of 125 microns to 100 microns. When iron oxide is employed as the iron bearing material, the iron oxide may suitably be introduced in the form of a fine size powder, preferably of an average particle size of about 44 microns to about 10 microns, and preferably comprises ferric oxide ($Fe_2O_3$), which may be conveniently derived from sources such as mill scale — a by-product of hot rolling steel, or the like. The iron oxide powder is preferably premixed with a fine-size particulated carbonaceous reducing agent, of which carbon powder itself of an average particle size ranging from about 44 microns to about 10 microns constitutes the preferred material. The quantity of carbon or other carbonaceous reducing agent is employed in an amount at least equal to that stoichiometrically required to effect a substantially complete reduction of the iron oxide to the metallic state in accordance with the following typical equation:

$$2Fe_2O_3 + 6C \rightarrow 4Fe + 6CO$$

Preferably, the carbon reducing agent is employed in excess of that stoichiometrically required and is usually controlled within a stoichiometric ratio of from about 1.05 to about 1.20 times that theoretically required. Amounts of carbon above about 20% in excess of that stoichiometrically required are undesirable due to the retention of excessive carbon in the resultant ferromolybdenum alloy pellets, rendering them less desirable as an alloying agent in some instances. It is also contemplated that small percentages of a carbonaceous reducing agent, such as carbon, can be incorporated with metallic iron powders when used as the iron bearing material in amounts up to about 1% for the purpose of reducing any oxides present on the particle surfaces, thereby providing ferromolybdenum alloys of relatively high purity.

The molybdenite constituent of the particulated mixture comprises a finely-particulated molybdenite which preferably has been concentrated so as to comprise predominantly molybdenum disulfide. In accordance with conventional practices, molybdenum disulfide containing feed stocks are commercially available as concentrates derived from various ore beneficiation processes to reduce the gangue and other contaminating constituents to concentrates generally less than about 40% by weight, with the balance comprising molybdenum disulfide. In accordance with a preferred practice, the molybdenite ore as mined is subjected to conventional flotation extraction processes which are carried out until the silica content of the powdered ore is usually less than about 20%, preferably less than about 8%, and sometimes as low as about 2%.

It is also possible to subject the ore to repeated grinding and flotation extraction cycles until the ore is reduced to an average particle size usually ranging from about 10 microns to about 250 microns, and whereby the silica content can be still further reduced to a level of as little as about 0.3% to about 0.5%. High purity molybdenite concentrates of the latter type are particularly suitable for use in the formulation of lubricants. Still further increases in the purity of the molybdenite concentrate can be achieved by subjecting the flotation extracted concentrate to an aqueous acid leaching process employing hydrofluoric acid, whereby the silica content is still further reduced to levels as low as about 0.02%. A process of the foregoing type is described in U.S. Pat. No. 3,101,252, owned by the assignee of the present invention and the teachings of which are incorporated herein by reference. Because of the volatilization of the impurities in the molybdenite concentrate, including the silica or gangue constituents, in accordance with the practice of the present invention, it generally is not necessary to subject the molybdenite concentrate to purification treatments to reduce the silica content to a level below about 20%.

The molybdenite concentrate derived from the oil flotation extraction process conventionally contains up to about 1% water and up to about 7% flotation oils, which usually comprise hydrocarbon oils such as pine oil and other oil substances of the type disclosed in U.S. Pat. No. 2,686,156. A removal of such flotation oils is not necessary since they are volatilized and/or thermally decompose during the thermal dissociation reaction.

The molybdenite concentrate and the iron powder or iron oxide/carbon powder mixture are blended mechanically in appropriate proportions to form a substantially homogeneous or uniform blend. The relative amounts of the two constituents can be adjusted so as to provide a ferromolybdenum alloy containing the desired ratio of molybdenum and iron. Generally, the relative proportions of the molybdenum disulfide and iron bearing material are adjusted so as to provide a ratio of molybdenum to iron ranging from about 60:40 to about 95:5, thereby producing dense sintered pellets of the ferromolybdenum alloy of substantially the same molybdenum-to-iron ratio (60% to 95% metallic molybdenum) due to the volatilization of the remaining constituents.

It is important that the mixture of the molybdenite and iron bearing material is first agglomerated into briquettes or pellets of a size which facilitates their handling and also assures the formation of a porous bed to permit an escape of the sulfur and other volatile constituents from the agglomerates during the thermal dissociation reaction and the escape of carbon monoxide if iron oxide is employed. The particular configuration and size of the pellets is not critical, and to some extent, will be dictated by the particular type of agglomerating process and equipment employed. Generally, pellets of a spherical configuration, such as derived from a disk-type pelletizing process, having diameters ranging from about $\frac{1}{8}$ inch up to about $\frac{1}{2}$ inch are satisfactory.

It is also important that the briquettes or pellets formed are of sufficient green strength so that they will not crush or deform when loaded as a static three-dimensional bed in a vacuum furnace, thereby assuring the retention of the porosity of the bed through which the volatile constituents can escape during the thermal dissociation reaction. Adequate green strength to enable a preliminary handling of the pellets, as well as providing the requisite final strength necessary during the initial stage of the thermal dissociation reaction can be imparted to the agglomerates by incorporating any one of a variety of inexpensive binder materials which volatilize without leaving any substantial residue under the temperatures and vacuum conditions present in the reactor. For this purpose, binder materials including starches, gelatines, sugars, molasses, $Na_2SiO_3$, etc., can be employed of which a dilute molasses solution has been found as being particularly satisfactory. Such binder materials are generally incorporated in amounts ranging from about 2% up to about 10%, with the specific amount used in any particular situation varying in consideration of such factors as the particular size of the molybdenite concentrate particles, the manner of agglomerating the concentrate and the size of the resultant pellets desired.

It is also contemplated in accordance with the practice of the present process that in addition to volatile binders, the pelletized molybdenite feed stock may further include a volatile particulated filler material which is adapted to volatilize during the thermal dissociation reaction, imparting increased porosity to the briquettes, thereby further facilitating an extraction of the other volatile constituents therein and enhancing the purity of the ferromolybdenum alloy product. Such volatile filler materials may range in size from about 10 microns to about 100 mesh (147 microns) and may be of regular or irregular configuration. The volatile filler may be solid in nature or may be porous, tubular, or hollow, thereby reducing the weight of material that must be volatilized to achieve a given porosity. Volatile filler materials may be comprised of any inexpensive substance that will volatilize without residue under the thermal dissociation conditions employed and without undergoing a violent or abrupt gasification, which might otherwise result in fracture, attrition or crumbling of the pellets during the initial phases of the thermal dissociation reaction. Particularly satisfactory materials are wood flour, sulfur, walnut shell flour, particles, beads and fibers of a thermoplastic resin which decompose without residue under the temperature conditions employed; microballoons composed of phenolic resins, and the like. The specific quantity of filler employed can be varied over wide limits to provide the desired volumetric percentage of potential porosity attributable to the filler and will vary depending on weight, size and filler configuration. The upper limit of filler that can be used is established by that at which inadequate pellet strength is obtained to prevent premature fracturing during the preliminary stages of the thermal dissociation reaction.

In accordance with a typical processing sequence, the molybdenum disulfide containing particulated concentrate is blended with an appropriate quantity of the iron powder and/or iron oxide/carbon mixture, whereafter appropriate quantities of binder and filler are added. The resultant mixture is agglomerated into pellets of the desired size and shape and the green pellets are subsequently dried and transferred to a pellet storage hopper. The resultant pellets can be charged to a vacuum smelting furnace either on a batchwise basis or on a continuous basis, as may be desired, to effect a heating thereof to an elevated temperature in the absence of oxygen and under a relatively high vacuum so as to effect a thermal dissociation and extraction of the volatile constituents, including the sulfur constituent and a reduction of any iron oxides present in the pelletized feed. The vacuum furnace may suitably be evacuated employing a vacuum pump which preferably is of a steam ejector type and also effects a transfer of the vaporized constituents through suitable condensers for effecting a recovery thereof as by-products.

In accordance with a preferred embodiment, a two-stage condensation is employed utilizing a first stage condenser at an elevated temperature above about 1000° F to effect a condensation of a portion of the contaminating constituents present in the molybdenum disulfide feed material and a second stage comparatively cold condenser of less than about 300° F for effecting a condensation of the sulfur constituent volatilized. In accordance with this two-stage condensation operation, a sulfur by-product of substantially higher purity is obtained. The condensed substances recovered from the first hot condenser also are of value dependent upon the particular source of the molybdenite ore and may advantageously be treated for the recovery of silver and other valuable metal constituents. The sulfur by-product recovered from the second stage cold condenser can be directly packaged and shipped without any further treatment. The resultant feromolybdenum pellets produced can suitably be packaged in steel containers providing premeasured quantities of ferromolybdenum alloy and in that form, can be utilized in conventional steelmaking and foundry operations.

The thermal dissociation of the molybdenum disulfide constituent and a reduction of the iron oxide, if employed in the pellets during the vacuum smelting operation, proceeds in accordance with the reaction equations as previousy set forth and wherein the sulfur, silica, binder, volatile filler, if any; carbon monoxide if iron oxide and carbon are employed; and other contaminating constituents are converted to the gaseous form and are extracted from the furnace by a suitable vacuum pump. The temperature of the reaction may range from as low as about 1800° F (982° C) to as high as 3100° F (1704° C), and preferably is controlled within a range of from about 2500° F to about 3100° F. Temperatures below about 2500° F are commercially unsatisfactory due to the slow rate of decomposition of the molybdenum disulfide, necessitating the use of extremely high vacuums in order to achieve an extraction of the sulfur and other volatile constituents in the pellets. On the other hand, temperatures above about 3100° F are undesirable because of excessive costs of refractories required. Particularly satisfactory results are achieved when the pelletized charge is heated at about 2700° F at a vacuum of $10^{-5}$ Torr to a temperature up to about 3100° F at a vacuum of 0.1 Torr, and preferably, 2800° F at 0.1 Torr to 2900° F at 3 Torr.

The heating of the pelletized charge to within the desired temperature range is achieved at a rate as quickly as possible without incurring fracture or rupture of the pellets due to the rapid gasification of the moisture and volatile constituents therein, thereby producing pellets of a porous nature which become progressively more porous as the thermal dissociation reaction proceeds until a temperature is attained at which some sintering and densification of the pellets occurs. When iron oxide in admixture with a carbonaceous reducing agent is employed as the source of the iron bearing material, the reduction of the oxide takes place commencing at a temperature of about 1800° F accompanied by a liberation of carbon monoxide gas. This occurs simultaneously with the thermal dissociation reaction. The temperature is gradually increased during the reaction to permit escape of the sulfur and other volatile constituents. The reaction itself is carried out for a period of time sufficient to effect a substantially complete thermal dissociation of the molybdenum disulfide constituent and a substantially complete reduction of the iron oxide, if employed. The limit of the reaction period is restricted by the attainment of an equilibrium condition in which the partial pressure of sulfur in the vapor within the vacuum furnace is equal to that of the residual sulfur contaminant in the pelletized feed stock.

The equilibrium condition can be advanced in the direction toward producing briquettes containing relatively minimal amounts of residual sulfur by employing higher vacuums up to a level dictated by the limitations of the vacuum equipment employed. Under such conditions, sulfur contents ranging from as high as several percent to as low as about 0.025% in the resultant briquettes can be achieved. As metallic molybdenum is produced during the course of the thermal dissociation reaction, the initial iron constituent or iron produced by the reduction of the oxide constituent becomes alloyed with the molybdenum producing a nonsegregated substantially dense pellet of ferromolybdenum alloy. The condition within the vacuum smelting furnace during the last stages of the reaction are controlled in temperature and vacuum so as to produce ferromolybdenum alloy pellets which contain less than about 0.10% sulfur, and preferably less than about 0.009% sulfur.

In accordance with a further embodiment of the present invention, the equilibrium condition can be advanced in the direction toward further reducing the residual sulfur in the briquettes by passing a substantially inert gas sweep through the briquettes while maintaining the required vacuum during the course of the thermal dissociation reaction, or alternatively, during the last stages thereof, whereby an acceleration of sulfur removal is effected. The use of a gas sweep results in penetration and removal of a static surface barrier layer and a reduction of the sulfur partial pressure around each of the briquettes which in turn increases the rate at which sulfur is removed. By the use of a gas sweep during all or a portion of the thermal dissociation vacuum smelting reaction, shorter residence times of the feed material in the vacuum furnace can be achieved to produce a product of equivalent residual sulfur content, or alternatively, to produce a product of reduced residual sulfur content for equivalent reaction residence times. In any event, the introduction of gaseous sweep is performed so as to maintain a vacuum within the reaction furnace within the permissible vacuum levels previously described. Any gas which is substantially inert, that is, which does not react with the charge, can be satisfactorily employed for this purpose, of which $H_2$, Ar, CO, $N_2$ and mixtures thereof are typical.

Upon completion of the reaction, the pelletized charge is permitted to cool to a temperature below about 570° F, whereafter the dense ferromolybdenum alloy product can be exposed to air such as by back-filling the vacuum smelting furnace and the product removed.

In order to further illustrate the process comprising the present invention, the following examples are provided. It will be understood that the examples hereinafter set forth are provided for illustrative purposes and are not intended to be limiting of the invention as herein described and as defined in the subjoined claims.

EXAMPLE 1

A series of test samples is prepared employing two different commercial grades of molybdenite concentrates and two different iron bearing materials. The molybdenite concentrates are derived from the oil beneficiation extraction process and typically contain up to about 1% water and up to about 7% flotation oils which are not removed and are utilized as the binder for preparing agglomerates of the particulated mixture possessing sufficient green strength to enable handling thereof. One molybdenite concentrate is of relatively high purity, designated as Grade 1; while the other is a relatively low purity concentrate, commercially designated as Regular Grade. The composition of these two molybdenite concentrates is set forth in Table 1.

Table 1

| Analyses of $MoS_2$ Concentrates | | |
|---|---|---|
| Element | Grade 1 | Regular Grade |
| C | 5.60% | 4.60% |
| Fe | 0.15% | 1.30% |
| Ag | 100 ppm | 160 ppm |
| Al | 0.15% | 0.78% |
| Ca | 0.14% | 0.38% |
| Cu | 360 ppm | 360 ppm |
| K | — | 0.20% |
| Mg | 180 ppm | 200 ppm |
| Mn | 50 ppm | 0.11% |
| Ni | 100 ppm | 100 ppm |
| Pb | 250 ppm | 0.11% |
| Si | 0.20% | 2.50% |
| Ti | 240 ppm | 600 ppm |
| V | 36 ppm | 13 ppm |
| Zn | — | 0.10% |
| $MoS_2$ | Balance | Balance |

The Grade 1 concentrate is of an average particle size of 37 microns, while the Regular Grade concentrate is of an average particle size of 44 microns.

Two sources of an iron bearing material were evaluated, namely: an iron powder of a nominal average particle size of 100 microns and an iron oxide ($Fe_2O_3$) powder of a nominal average particle size of 44 microns. The reducing agent employed when the iron oxide powder is used comprises carbon powder of a nominal particle size of 44 microns. In each instance that iron oxide is employed, the carbon and iron oxide powder is preliminarily mixed to form a uniform blend, which thereafter is admixed with appropriate proportions of the molybdenum concentrate.

Appropriate proportions of the particulated materials are mixed to form a uniform blend and are thereafter agglomerated into pellets employing a hand-operated laboratory Parr pelletizing press having a pressure ratio of 20:1. The resultant cylindrical pellets are nominal ⅜ inch diameter by ⅜ inch in length, and are of sufficient green strength to withstand dropping 4 feet without appreciable breakage. The specific composition and constituents of the test samples are set forth in Table 2.

Table 2

| Sample Composition | | |
|---|---|---|
| Sample | | Composition |
| AM | 90 gr | Reg. Grade $MoS_2$, 1.57gr $Fe_2O_3$, .34gr C |
| AN | 90 gr | Reg. Grade $MoS_2$, 3.28gr $Fe_2O_3$, .77gr C |
| AO | 90 gr | Reg. Grade $MoS_2$, 6.57gr $Fe_2O_3$, 1.54gr C |
| AP | 90 gr | Reg. Grade $MoS_2$, 7.13gr $Fe_2O_3$, 1.57gr C |
| AR | 90 gr | Reg. Grade $MoS_2$, 8.50gr $Fe_2O_3$, 1.90gr C |
| BE | 90 gr | Reg. Grade $MoS_2$, 2gr Fe, 1.5gr C |
| AI | 90 gr | Grade I $MoS_2$, 1.1gr Fe |
| AJ | 90 gr | Grade I $MoS_2$, 2.2gr Fe |
| AG | 90 gr | Grade I $MoS_2$, 5gr Fe |
| AH | 90 gr | Grade I $MoS_2$, 10gr Fe |
| AL | 90 gr | Grade I $MoS_2$, .57gr $Fe_2O_3$, .34gr C |
| AK | 90 gr | Grade I $MoS_2$, 3.28gr $Fe_2O_3$, .77gr C |

Each of the pelletized samples are individually charged into a small laboratory vacuum furnace provided with a carbon felt lining and a carbon resistor heating element and is equipped with a vacuum pumping system capable of producing a vacuum of 50 microns with a roughing pump and a vacuum of less than 1 micron when a diffusion pump is also employed. Each of the pelletized samples is heated to 2800° F under vacuum and is held for a period of 1 hour upon attainment of 2800° F, followed by a cooling and stabilizing stage, whereafter the sintered ferromolybdenum alloy pelletized product is removed. The composition of the resultant ferromolybdenum alloy pelletized product and the terminal vacuum conditions in the furnace at the completion of the heating cycle are set forth in Table 3.

Table 3

| Ferromolybdenum Product Analysis | | | | | |
|---|---|---|---|---|---|
| | Product | | | | Furnace Thermal |
| Sample | % Fe | % S | % C | % Mo | Vacuum |
| AM | 2.50 | .04 | .07 | 93.30 | 400 μ |
| AN | 2.90 | .04 | .04 | 94.12 | 150 μ |
| AO | 6.85 | .08 | .06 | 88.30 | 150 μ |
| AP | 6.50 | .02 | .06 | 90.50 | 150 μ |
| AR | 10.97 | .02 | .06 | 85.52 | 170 μ |
| BE | 5.60 | .008 | .06 | 93.80 | 90 μ |
| Al | .345 | .04 | .06 | 99.16 | 150 μ |
| AJ | 3.70 | .04 | .05 | 95.7 | 200 μ |
| AG | 8.75 | .02 | .03 | 90.43 | 600 μ |
| AH | 15.05 | .03 | .03 | 83.56 | 900 μ |
| AL | 1.40 | .02 | .08 | 98.06 | 400 μ |
| AK | 2.70 | .04 | .08 | 96.81 | 400 μ |

EXAMPLE 2

A second series of test samples comprising two groups, each comprising three batches of pellets of identical composition, are prepared in the same manner as described in Example 1 and are subjected to a heating at three different temperatures for a period of 1 hour each to evaluate the effect of furnace temperature conditions on the composition of the ferromolybdenum alloy pelletized product. The composition of the pelletized charge material is set forth in Table 4; and the composition of the pelletized ferromolybdenum alloy product, as well as the furnace temperature and terminal vacuum conditions, are set forth in Table 5.

Table 4

| Sample Composition | |
|---|---|
| Sample | Composition |
| BA | 90gr Reg. Grade $MoS_2$, 3.28gr $Fe_2O_3$, .77gr C |
| AZ | 90gr Reg. Grade $MoS_2$, 3.28gr $Fe_2O_3$, .77gr C |
| AY | 90gr Reg. Grade $MoS_2$, 3.28gr $Fe_2O$, .77gr C |
| AX | 90gr Reg. Grade $MoS_2$, 1.57gr $Fe_2O_3$, .34gr C |
| AW | 90gr Reg. Grade $MoS_2$, 1.57gr $Fe_2O_3$, .34gr C |
| AV | 90gr Reg. Grade $MoS_2$, 1.57gr $Fe_2O_3$, .34gr C |

Table 5

| Ferromolybdenum Product Analysis | | | | | | |
|---|---|---|---|---|---|---|
| | Product | | | | Furnace Conditions | |
| Sample | % Fe | % S | % C | % Mo | Temp. ° F | Terminal Vacuum |
| BA | 5.08 | .06 | .07 | 92.80 | 2700 | 175 μ |
| AZ | 6.78 | .03 | .03 | 90.93 | 2800 | 150 μ |
| AY | 6.23 | .03 | .03 | 92.80 | 2900 | 200 μ |
| AX | 3.65 | .06 | .05 | 93.86 | 2700 | 150 μ |
| AW | 3.57 | .09 | .09 | 95.77 | 2800 | 200 μ |
| AV | 2.43 | .04 | .09 | 95.82 | 2900 | 100 μ |

EXAMPLE 3

A pelletized feed material is prepared in the same manner as previously described in connection with Example 1 having a composition as follows: 90gr Reg. Grade $MoS_2$, 3.28gr $Fe_2O_3$ and 1.0gr C. Individual batches of the pelletized feed material are evaluated under different vacuum furnace conditions to determine the effect of time, temperature and terminal vacuum on the amount of residual sulfur present in the pelletized ferromolybdenum alloy product. The results are set forth in Table 6.

Table 6

| Furnace Conditions Affecting Sulfur in Product | | | |
|---|---|---|---|
| Terminal Vacuum of 1500 Microns | | | |
| Sample | Hold Temp ° F | Time at Temp. | % S in Product |
| BW | 2900 | 3 hours | 0.138 |
| BV | 2900 | 2 hours | 0.938 |
| BU | 2900 | 1 hour | 3.830 |
| BP | 2800 | 3 hours | 0.91 |
| BQ | 2800 | 2 hours | 1.12 |
| BR | 2800 | 1 hour | 0.80 |
| BO | 2700 | 3 hours | 17.98 |
| BN | 2700 | 2 hours | 17.85 |
| BM | 2700 | 1 hour | 21.06 |
| BS | 2600 | 3 hours | 20.30 |
| Terminal Vacuum of 1000 Microns | | | |
| BX | 2900 | 1 hour | .058 |
| BY | 2800 | 1 hour | .938 |
| BZ | 2700 | 1 hour | 3.830 |
| Terminal Vacuum of 500 Microns | | | |
| CA | 2900 | 1 hour | 0.014 |
| CB | 2800 | 1 hour | 0.014 |
| CL | 2700 | 1 hour | 0.073 |

EXAMPLE 4

A pelletized test feed material is prepared in the same manner as previously described in Example 1 containing: 90gr Reg. Grade $MoS_2$, 3.28gr $Fe_2O_3$, 1.2gr C. The pelletized charge is heated to a temperature of 2800° F for a period of 1 hour and the volatilized constituents are recovered on a hot condenser incorporated in the vacuum line maintained at a temperature of +1000° F and on a cold condenser at a temperature of below 300° F. An analysis of the condensed product recovered in both condensers is set forth in Table 7.

Table 7

| Condensed Product Analyses | | |
|---|---|---|
| | Hot Condenser +1000° F | Cold Condenser <300° F |
| Ag | 0.10% | — |
| Al | 750PPM | 75PPM |
| B | 50PPM | 50PPM |
| Be | 2.00% | — |
| Bi | 230PPM | — |
| Ca | 180PPM | 60PPM |
| Cu | 900PPM | 200PPM |
| Fe | 0.50% | 150PPM |
| Ga | 0.13% | — |
| K | 2.00% | — |
| Li | 0.20% | — |
| Mg | 500PPM | 60PPM |
| Mn | 250PPM | — |
| Mo | 0.23% | 200PPM |
| Na | 2.00% | — |
| Ni | 150PPM | — |
| Pb | 2.50% | 150PPM |
| Rb | 0.15% | — |
| Si | Major | 0.18% |
| Ti | 170PPM | — |
| W | 750PPM — | |
| Zn | 1.00% | 200PPM |

Table 7-continued

| | Condensed Product Analyses | |
|---|---|---|
| | Hot Condenser +1000° F | Cold Condenser <300° F |
| Zr | 750PPM | — |

The condensate or the condensed product of the cold condenser comprises a relatively pure sulfur by-product, while the condensed material recovered in the hot condenser is also of economic value for recovery of valuable metals such as silver.

While it will be apparent that the invention herein described is well calculated to achieve the benefits and advantages set forth above, it will be appreciated that the invention is susceptible to modification, variation and change without departing from the spirit thereof.

What is claimed is:

1. A process for preparing a ferromolybdenum alloy which comprises the steps of forming a substantially uniform mixture composed of a finely-particulated molybdenite concentrate containing at least about 60% of molybdenum disulfide and a finely-particulated iron bearing material selected from the group consisting essentially of metallic iron, iron oxide and mixtures thereof, agglomerating said mixture into a plurality of shape-retaining pellets, heating said pellets to an elevated temperature above about 1800° F in a nonoxidizing atmosphere for a period of time sufficient to effect a dissociation of substantially all of the molybdenum disulfide therein while under a pressure of less than about 10 Torr forming metallic molybdenum, continuously withdrawing the gaseous sulfur and other volatile contaminating constituents in said pellets, continuing the heating of said pellets to effect an alloying of said metallic molybdenum with the iron constituent to produce a ferromolybdenum alloy, and thereafter cooling and extracting the substantially dense sintered ferromolybdenum alloy pellets.

2. The process as defined in claim 1, in which the step of heating said pellets to an elevated temperature is performed within a temperature ranging from about 2500° F up to about 3100° F.

3. The process as defined in claim 1, wherein the step of heating said pellets to an elevated temperature is performed under conditions in which the temperature ranges from about 2800° F at 0.1 Torr to about 2900° F at about 3 Torr.

4. The process as defined in claim 1, in which the step of forming a substantially uniform mixture is performed so as to provide a pellet containing from about 60% up to about 95% molybdenum disulfide.

5. The process as defined in claim 1, in which the step of forming a substantially uniform mixture is performed wherein said finely-particulated iron bearing material comprises metallic iron.

6. The process as defined in claim 1, wherein the step of forming a substantially uniform mixture is performed wherein said finely-particulated iron bearing material comprises iron oxide and said mixture further includes a carbonaceous material as a reducing agent for said iron oxide present in an amount slightly in excess of the stoichiometric ratio required to effect a reduction of said iron oxide to the metallic state during the subsequent heating step.

7. The process as defined in claim 1, in which the step of heating said pellets to an elevated temperature under a pressure of less than about 10 Torr is performed in the presence of an inert gas sweep.

8. The process as defined in claim 1, in which the step of continuously withdrawing the gaseous sulfur includes the further step of condensing and recovering the gaseous sulfur evolved.

9. The process as defined in claim 1, including the further step of passing the gaseous sulfur and other volatile contaminating constituents continuously withdrawn through a two-stage condenser wherein the first stage is at elevated temperature to effect a condensation of said other volatile contaminating constituents and the second stage is at a lower temperature for condensing and recovering the gaseous sulfur constituent.

10. The process as defined in claim 1, in which the step of cooling the sintered ferromolybdenum alloy pellets is performed to effect a cooling thereof to a temperature below about 570° F before the extraction thereof.

11. The process as defined in claim 1, in which the step of forming a substantially uniform mixture further includes incorporating a binder in said mixture in an amount of about 2% to about 10% prior to the step of agglomerating said mixture.

12. The process as defined in claim 1, in which the step of forming a substantially uniform mixture further includes mixing with said mixture a controlled proportion of a volatile particulated filler material adapted to volatilize during the heating step to enhance porosity of said pellets.

13. The process as defined in claim 12, in which said volatile filler is of an average particle size ranging from about 10 microns to about 147 microns.

14. The process as defined in claim 1, in which the step of agglomerating said mixture is performed to produce substantially spherical shaped pellets of an average size of from about ⅛ inch to about ½ inch in diameter.

15. The process as defined in claim 1, in which said molybdenite concentrate is controlled within an average particle size of about 10 microns to about 250 microns.

16. The process as defined in claim 5, in which said metallic iron is of an average particle size of about 74 microns to about 175 microns.

17. The process as defined in claim 6 in which said iron oxide is of an average particle size of from about 10 microns to about 44 microns.

18. The process as defined in claim 6, wherein said carbonaceous material comprises carbon of an average particle size of about 10 microns to about 44 microns.

19. The process as defined in claim 6, in which said carbonaceous material is controlled within a stoichiometric ratio of about 1.05 to about 1.2 times that theoretically required to reduce the iron oxide to the metallic state.

20. The process as defined in claim 1, in which the step of heating said pellets to an elevated temperature is performed for a period of time sufficient to produce ferromolybdenum alloy pellets containing less than about 0.10% sulfur.

* * * * *